US006790309B2

(12) United States Patent
Miyagawa et al.

(10) Patent No.: US 6,790,309 B2
(45) Date of Patent: Sep. 14, 2004

(54) METHOD FOR MANUFACTURING INK JET HEAD AND INK JET HEAD MANUFACTURED BY SUCH METHOD

(75) Inventors: Masashi Miyagawa, Kanagawa (JP); Yoshiaki Kurihara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 10/025,534

(22) Filed: Dec. 26, 2001

(65) Prior Publication Data

US 2002/0105562 A1 Aug. 8, 2002

(30) Foreign Application Priority Data

Dec. 28, 2000 (JP) ..... 2000-402214
Dec. 5, 2001 (JP) ..... 2001-371348

(51) Int. Cl.[7] ..... B41J 2/01

(52) U.S. Cl. ..... 156/272.2; 156/275.5; 156/275.7; 347/20

(58) Field of Search ..... 156/272.2, 275.5, 156/275.7, 325, 330; 347/20

(56) References Cited

U.S. PATENT DOCUMENTS

| | | | | | |
|---|---|---|---|---|---|
| 4,108,747 | A | * | 8/1978 | Crivello | 522/31 |
| 5,262,232 | A | * | 11/1993 | Wilfong et al. | 428/327 |
| 6,455,112 | B1 | * | 9/2002 | Ohkuma et al. | 427/504 |
| 6,652,702 | B2 | * | 11/2003 | Miyazaki et al. | 156/272.2 |
| 6,659,588 | B2 | | 12/2003 | Ikegame et al. | 347/40 |
| 2003/0011655 | A1 | | 1/2003 | Miyagawa et al. | 347/20 |

FOREIGN PATENT DOCUMENTS

| | | | | | |
|---|---|---|---|---|---|
| EP | 0761448 | A2 | | 3/1997 | |
| EP | 0847079 | A2 | | 6/1998 | |
| JP | 9-24613 | | | 1/1997 | |
| JP | 9-118017 | | | 5/1997 | |
| JP | 11179923 | A | * | 7/1999 | B41J/2/16 |
| JP | 11188873 | A | * | 7/1999 | B41J/2/05 |

* cited by examiner

*Primary Examiner*—Jeff H. Aftergut
*Assistant Examiner*—John T. Haran
(74) *Attorney, Agent, or Firm*—Fitzpatrick, Cella, Harper & Scinto

(57) ABSTRACT

A method for manufacturing an ink jet head by bonding with liquid-like adhesive a member at least having a discharge port for discharging ink, and a substrate having energy generating elements to generate energy for discharging ink comprises the steps of coating the liquid-like adhesive on the member or the substrate, the liquid-like adhesive containing at least ultraviolet curing cation polymeric starter and epoxy resin; irradiating ultraviolet rays to the liquid-like adhesive to activate the ultraviolet curing cation polymeric starter; positioning the member and the substrate without heating process; and heating in a state of the member and the substrate being positioned to cure the activated liquid-like adhesive. With the method thus structured, the ink jet head can be manufactured with excellent stability of preservation, while making it not only possible to position the ink discharge port and the energy generating element on the substrate of the ink jet head in high precision at low temperature for bonding but also, to implement high resistance to ink and heat after the adhesive has been cured.

8 Claims, 12 Drawing Sheets

METHOD FOR MANUFACTURING INK JET HEAD AND INK JET HEAD MANUFACTURED BY SUCH METHOD

BACKGROUND OF THE INVENTION

1. Field of the Invention

The present invention relates to a method for manufacturing an ink jet head that performs recording, which is used for a printer, a video printer, or the like as an output device of a copying machine, a facsimile equipment, a word processor, a host computer, or the like. The invention also relates to a method of manufacture therefor. In this respect, recording includes the provision of ink (printing) on cloth, thread, paper, sheet material, or the like, and also, includes not only the printing of characters but also, that of pictorial images, such as patterned images.

2. Related Background Art

The ink jet printing method has an extremely small amount of noises at the time of printing, and is capable of performing high-speed printing. This printing method makes it easier to execute color printing in a compact form. As one of ink jet printing methods, there is one type that ink is bubbled by means of heat generating element, and ink is discharged utilizing the growth of the bubble. FIG. 1 shows schematically one example of the conventional ink jet head H used for the type of the kind.

In FIG. 1, a reference numeral 4 designates a flexible wiring substrate; 5, external connecting terminals; 6, a wiring substrate; 7, a structural member; 10, a substrate for forming electrothermal converting element; 20, a nozzle structural member, which is a complexly formed structure; and 21, a discharge port.

FIG. 2 is an enlarged perspective view that shows the discharge element T of the ink jet head H represented in FIG. 1. This discharge element T is referred to the ink jet head disclosed in the specification of Japanese Patent Laid-Open Application 09-118017 filed by Lexmark Inc. in USA, for example. FIGS. 3, 4, 5, 6 and 7 are views that illustrate the manufacturing process thereof.

FIG. 3 shows the section of the nozzle structural member 20 in a stage prior to manufacture, which is formed by polymer film material 22 and adhesive layer 23. The polymer film material 22 is polyimide, fluorocarbon, polysulfone, polycarbonate, polyester, or the like. Preferably, it is polyimide.

Next, as shown in FIG. 4, the protection layer 24 is formed on the adhesive layer 23.

As a water repellent film formed on the ink discharge surface side, for example, it is preferable to form a polymer film having silicon or fluorine atom. Also, it is a technique generally used that a protection layer 24 is formed in advance on the water repellent film or the adhesive layer 23, and after laser processing, the protection layer 24 is removed so as to easily remove such by-product (debris, fragment) as has been produced by laser processing.

As one preferable example of the protection layer, there can be cited means for coating water soluble resin, such as PVA, disclosed in the specification of the aforesaid Japanese Patent Laid-Open Application 09-118017. For the coating of such resin film, the polymeric material is dissolved in advance in a solvent that may dissolve it, and applied by means of solvent coating method in general. As the solvent coating method, there is spin coat, bar coat, gravure roll coat, spray coat, or the like.

Next, laser processing is conducted through a mask, and ink flow path 26 and discharge port 21 are formed as shown in FIG. 5. At this juncture, the by-product 40 is produced simultaneously with the laser processing, which adheres to the protection layer 24. Next, with the removal of the protection layer 24, such by-product 40 is also removed. Then, as shown in FIG. 6, the adhesive layer 23 of the nozzle structural member 20 and the substrate 10, which is manufactured by means of semiconductor process, are bonded to form the discharge element T as shown in FIG. 7.

Also, FIG. 8 shows an ink jet head the structure of which differs from the one described above.

FIG. 9 is a cross-sectional view that shows the ink jet head represented in FIG. 8, which is formed by a ceiling plate member 102, liquid flow path, a heater substrate 101. A plurality of heat generating resistive members 105 is arranged for the heater substrate 101.

Also, FIG. 10 is a cross-sectional view that schematically shows an ink jet head the discharge efficiency and refilling characteristic of which are enhanced. This ink jet head comprises a ceiling plate member 102, movable member 120, upper displacement regulating member 122, and a heater substrate 101. A plurality of heat generating resistive members 105 is arranged for the heater substrate 101. The heat generating resistive member 105 is heated, and energy exerted by the bubbling of ink enables the movable member 120 to move. With the upper displacement regulating member 122 that regulates the upper displacement of the movable member 120, it is intended to make the bubble energy more efficient. For the ink jet head shown in FIG. 10, the liquid chamber and ink supply hole are formed for the ceiling plate member 102 as in FIG. 9 by means of Si anisotropic etching or blast processing.

As shown in FIG. 9 or FIG. 10, when liquid flow path is formed on the heater substrate, a substance of epoxy resin composition of liquid photo-cation curing type is coated on the substrate by spin coating method or the like, and then, the flow path is formed by the photolithographic technique using ultraviolet ryas or the like. After the liquid flow path is formed on the heater substrate, the ink jet discharge element bonded with the ceiling plate member is obtained, to which the orifice plate is adhesively bonded to obtain an ink jet head. Conventionally, a substance composed of thermo-curing epoxy resin has been used for bonding the heater substrate and the ceiling plate member.

For the structure described above, the adhesive is required to provide high resistance to ink and heat, because it is in contact with ink. Therefore, this agent is formed by epoxy resin. However, the epoxy resin adhesive is fundamentally composed of two component, main agent and curing agent. As a result, viscosity may change after mixture to make it extremely difficult to retain the mixture stably. This suggests a specific time limit for the process in which the adhesive is prescribed, coated, and used for bonding, which tends to lead to the lower productivity. If acid anhydride, imidazole, or the like is used as curing agent, the curing capability of epoxy resin is lowered to make the preserving stability higher. There is, however, a need for giving a high curing temperature for a long time. As a result, in a case of an ink jet head at least having the member, which is provided with a discharge port formed by polymeric film 22, the positional displacement may occur between the discharge port 21 and heater due to the difference in the linear expansion coefficient thereof with that of the substrate 10.

Also, when bonding is made by use of the substance composed of thermo-curing epoxy resin, the epoxy resin is soften and melted at the time of curing, and in some cases, the melted resin flows along the liquid flow path walls to clog the flow path, thus causing defective discharge. Particularly, in the case where movable member exists as shown in FIG. 10, the melted epoxy resin flows by means of capillary force to bury the circumference of the structural member, hence causing the movement of the movable member to be disabled sometimes.

To deal with the problems discussed above, there is a disclosure in the specification of Japanese Patent Laid-Open Application 09-24613 that the two members are bonded by use of epoxy resin of UV cation curing type so as to reduce the influence that may be exerted by heat. The flow of bonding process is shown in FIGS. 11A, 11B, 11C, 11D and 11E. Adhesive 23 is coated on the substrate 1 (FIG. 11A), and UV is irradiated through a mask 30 (FIG. 11B). Next, heating is given, and development is made (FIG. 11C). Then, after the fine pattern, which is formed by adhesive, is composed, another member 31 is bonded (FIG. 11D), and heated under pressure to perform the regular curing (FIG. 11E). This bonding method is effective means when the thickness of adhesive is 20 $\mu$m to 30 $\mu$m.

SUMMARY OF THE INVENTION

In recent years, however, the ink jet head becomes highly precise along with the demand on the higher quality of recorded images, and the thickness of adhesive is required to be smaller accordingly. Now, the thickness of the adhesive is made less than 20 $\mu$m, for example, for the experiment and studies, and the following is found. In other words, in the process of beam irradiation needed for the formation of fine pattern, the curing reaction of epoxy resin advances greatly to the extent that the adhesive has almost no flowability when bonding is processed. Consequently, only an extremely small bonding strength is obtainable.

Also, the UV-cation curing epoxy adhesive is effective when applied to the material that transmits ultraviolet rays. It is known, however, that this agent does not effectuate bonding in good condition in some cases if applied to the material that does not transmit ultraviolet rays.

The present invention is designed in consideration of these problems. It is an object of the invention to provide a method for manufacturing an ink jet head, to which is applicable the adhesive having ultraviolet curing cation polymeric starter and epoxy resin contained therein, with excellent stability of preservation, and which makes it not only possible to implement high resistance to ink and heat after the adhesive has been cured, but also, to position the ink discharge port and the electrothermal converting element on the substrate in high precision at low bonding temperature.

The present invention is able to solve the aforesaid problems by means of the technical formation given below. In other words, the method of the present invention for manufacturing an ink jet head by bonding with liquid-like adhesive a member at least having a discharge port for discharging ink, and a substrate having an energy generating element to generate energy for discharging ink comprises the steps of coating the liquid-like adhesive on the member or the substrate, the liquid-like adhesive containing at least ultraviolet curing cation polymeric starter and epoxy resin; irradiating ultraviolet rays to the liquid-like adhesive to activate the ultraviolet curing cation polymeric starter; positioning the member and the substrate without heating process; and heating in a state of the member and the substrate being positioned to cure the activated liquid-like adhesive.

Also, the thickness of the adhesive layer is 10 $\mu$m or less.

Also, the aforesaid ultraviolet curing cation polymeric starter is aromatic onium salt.

Also, the aforesaid liquid-like adhesive contains agent for providing flexibility.

Also, the member and the substrate are formed by material having Si as the main component thereof.

Also, the ultraviolet ryas are beams of wavelength of 380 nm or less.

Also, at least either one of the member and the substrate is formed by opaque material to the beam having wavelength of 380 nm or less.

Further, the method of the present invention for manufacturing an ink jet head by bonding with solid adhesive a member at least having a discharge port for discharging ink, and a substrate having an energy generating element to generate energy for discharging ink comprises the steps of coating adhesive on the member or the substrate, the solid adhesive containing at least ultraviolet curing cation polymeric starter and epoxy resin; irradiating ultraviolet rays to the liquid-like adhesive to activate the ultraviolet curing cation polymeric starter; positioning the member and the substrate without heating process; and heating the activated solid adhesive in a state of the member and the substrate being positioned to perform curing, while melting the solid adhesive.

Also, the melting point of epoxy resin of the aforesaid solid adhesive is 50° C. or more and 120° C. or less.

Further, the method of the present invention for manufacturing an ink jet head by forming a complex structure having at least adhesive layer on polymeric film material, and bonding the structure with the substrate having an electrothermal converting element formed therefor after forming more than one discharge port, ink flow path, and liquid chamber by performing laser processing to the complex structure comprises the steps of laminating the adhesive layer containing at least ultraviolet curing cation polymeric starter and epoxy resin on the polymeric film material; forming more than one discharge port by laser irradiation on the polymeric film material having the adhesive layer laminated; activating the ultraviolet curing cation polymeric starter by irradiating ultraviolet rays to the adhesive; positioning the member and the substrate without heating process; and heating in a state of the member and the substrate being positioned to cure the activated adhesive.

Further, the method of the present invention for manufacturing by bonding with adhesive a member at least having a discharge port for discharging ink, and a substrate having an energy generating element to generate energy for discharging ink comprises the steps of producing a dry film of the adhesive containing at least ultraviolet curing cation polymeric starter and epoxy resin; transferring the adhesive to the member or the substrate; activating the ultraviolet curing cation polymeric starter by irradiating ultraviolet rays to the adhesive; positioning the member and the substrate without heating process; and heating in a state of the member and the substrate being positioned to cure the activated adhesive.

Also, the ink jet of the present invention is the one manufactured by the aforesaid method for manufacturing an ink jet head.

BRIEF DESCRIPTION OF THE DRAWINGS

FIG. 5 is a cross-sectional view which shows the nozzle structure to which the present invention is applicable in a state where laser processing has been given to the discharge port, ink flow path, and the like;

FIG. 14 is a cross-sectional view which shows the nozzle structure of the present invention in a state where laser processing has been given to the discharge port, ink flow path, and the like;

DETAILED DESCRIPTION OF THE PREFERRED EMBODIMENTS

Figure 1:
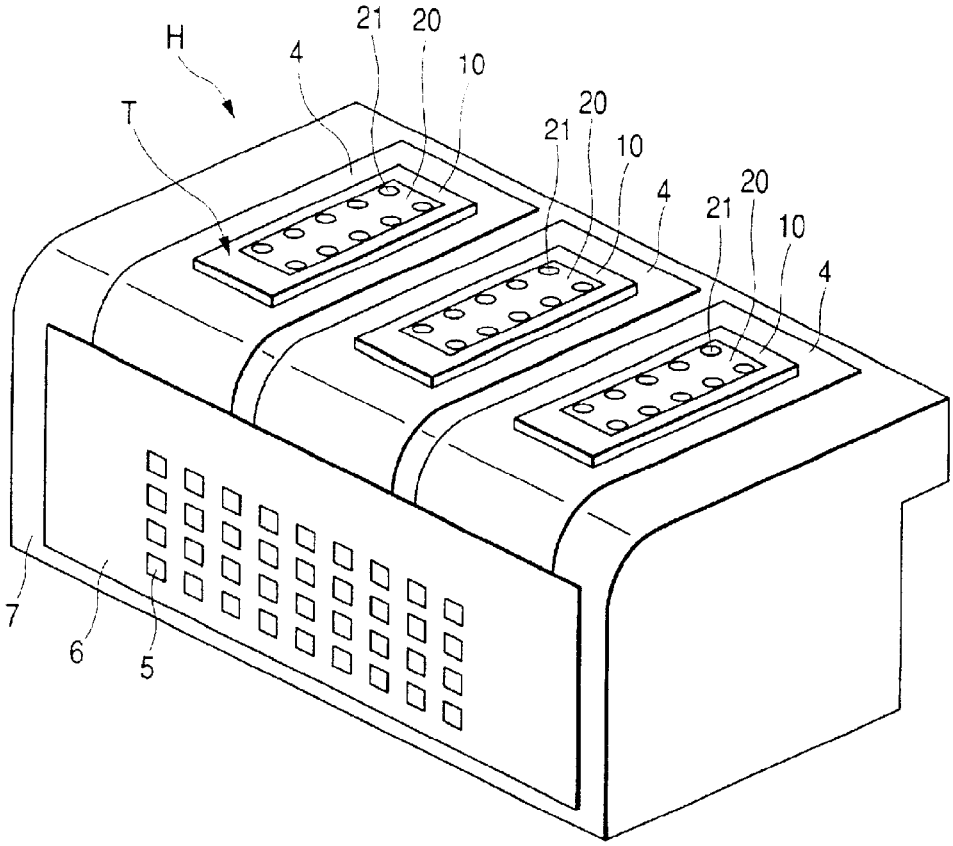
FIG. 1 is a view that schematically shows the ink jet head to which the present invention is applicable.
Figure 2:
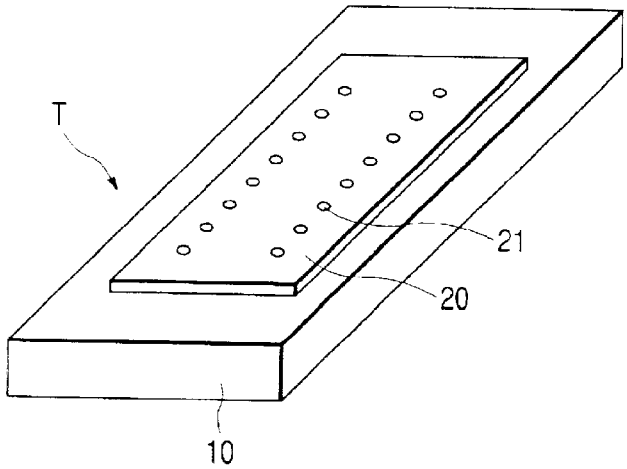
FIG. 2 is an enlarged perspective view that shows the discharge element of the ink jet head to which the present invention is applicable.
Figure 3:
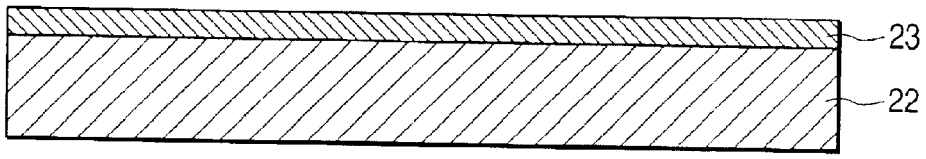
FIG. 3 is a cross-sectional view that shows the nozzle structure to which the present invention is applicable in a stage before a protection layer is formed.
Figure 4:
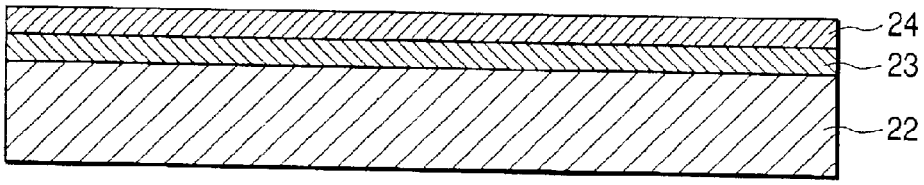
FIG. 4 is a cross-sectional view that shows the nozzle structure to which the present invention is applicable in a state where the protection layer is formed on the adhesive layer side.
Figure 5:
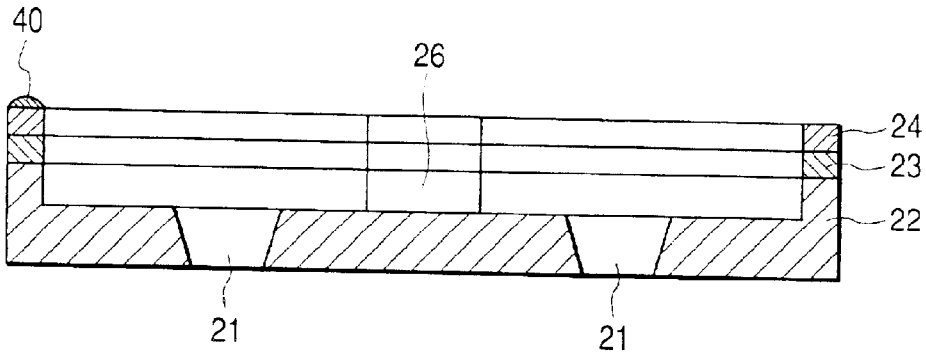
Figure 6:
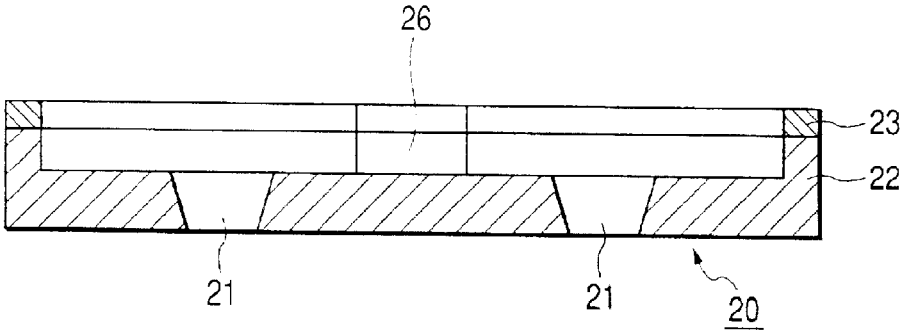
FIG. 6 is a cross-sectional view which shows the nozzle structure to which the present invention is applicable in a state after the protection layer is removed.
Figure 7:
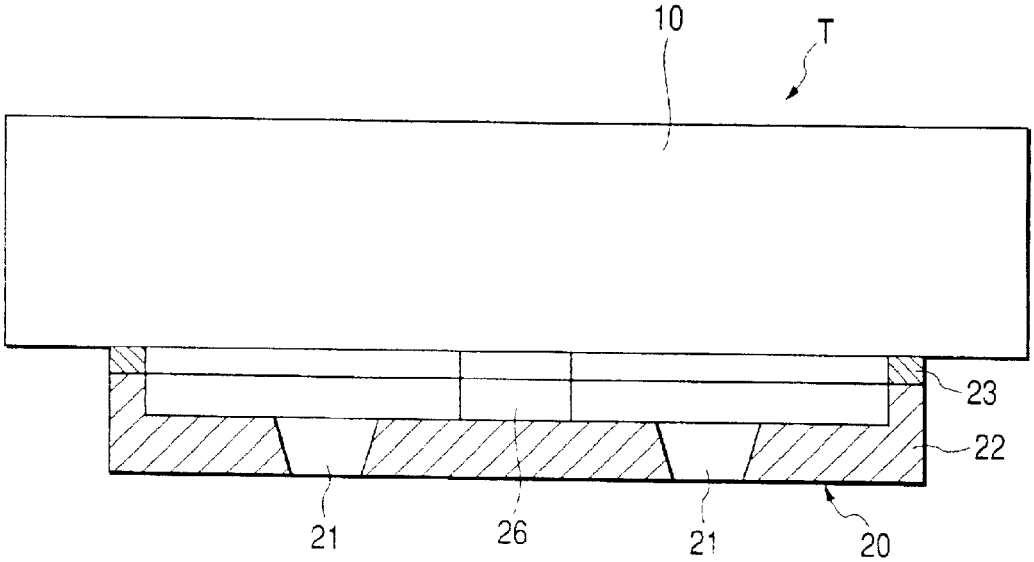
FIG. 7 is a cross-sectional view that shows the discharge element formed by bonding the nozzle structural member and the substrate, to which the present invention is applicable.
Figure 8:
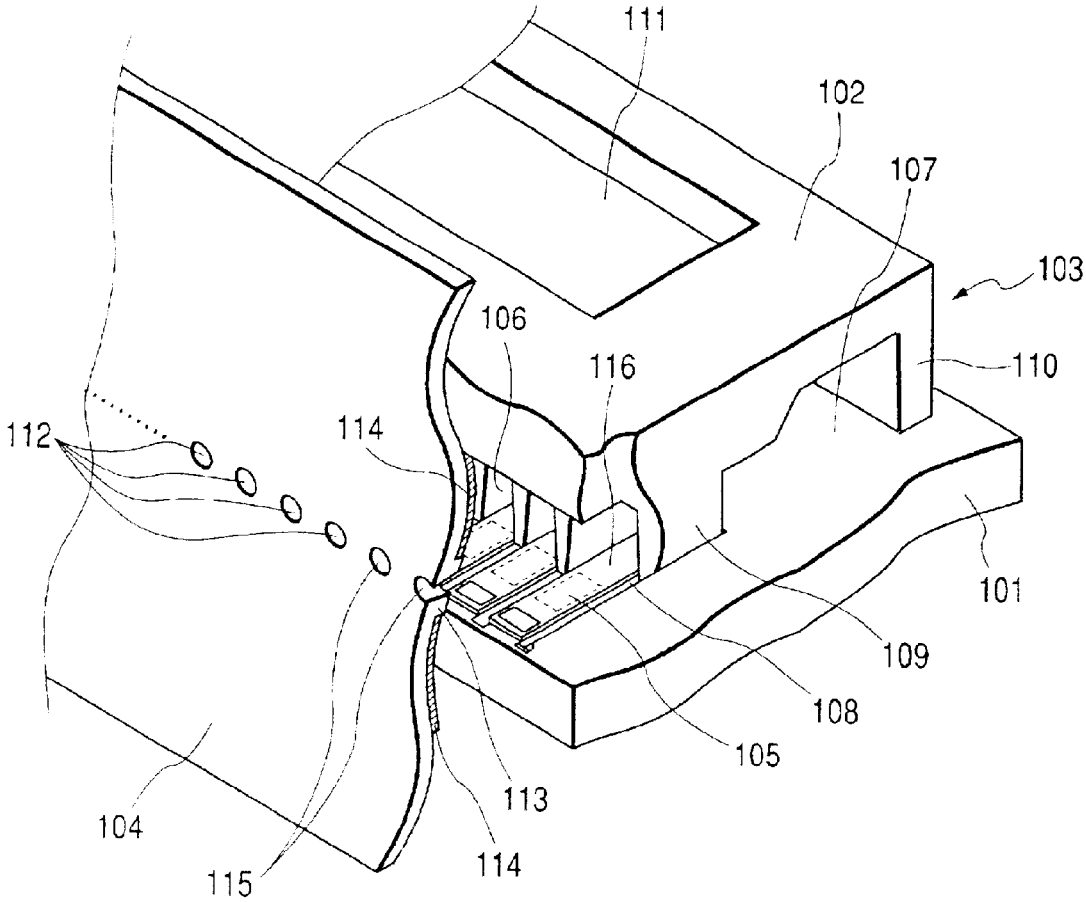
FIG. 8 is an enlarged perspective view that shows the discharge element of the ink jet head to which the present invention is applicable.

Hereinafter, the detailed description will be made of the embodiments in accordance with the present invention.

The substance composed of epoxy resin is formed at least by epoxy resin and ultraviolet curing cation polymeric starter, and in order to enhance the bonding strength and achieve various properties, such as the control of heat flow property, it is possible to appropriately use the commonly known compound of the substance composed of epoxy resin, such as binder, filler, coupling agent, flame retardant, flexibility providing agent, curing promoting agent.

For the epoxy resin serving as the main agent, any epoxy resin may be usable if only it has epoxy ring in the molecular structure. Generally, phenol novolac epoxy resin, cresol novolac epoxy resin, bisphenol A epoxy resin, bisphenol F epoxy resin, modified epoxy resin, or the like can be cited as usable.

When liquid-like adhesive is used at normal temperature, it is possible to use, for example, Epiclone 830, 835, 840 and 850, and Epicoat 828 and others (Product name: sold by Dai Nippon Ink K.K.).

For the epoxy resin used in solid form at normal temperature, it is possible to select the one appropriately from among Epon SU-8 (manufactured by Shell Chemical Inc.) or other multifunctional bisphenol novolac epoxy as the bisphenol A novolac epoxy resin, or from among Epicoat 1001, 1007, 1010, or the like (molecular weight: 900 to 5,500) (manufactured by Oil Shell Epoxy Inc.) as the bisphenol A epoxy resin. Also, more preferably, those having the melting point at 50° C. or more and 120° C. or less should be selected from among bisphenol A epoxy resin, bisphenol A novolac epoxy resin, novolac epoxy resin, and bisphenol F epoxy resin. As the bisphenol A epoxy resins, it is possible to use Epicoat 1001, 1002, 1003, 1004, 1004AF, 1003F, or 1004F (product name: sold by Oil Shell Epoxy Inc.); as bisphenol A novolac epoxy resin, 157S70 and 157H70 sold by this incorporation; and as orthocresol novolac epoxy resin, 180S65, 180H65, or the like sold likewise by this incorporation.

Also, these epoxy resins may be used in a mixture of plural kinds. Usually, the epoxy resin has a comparatively low molecular weight, and once melted, viscosity is lowered rapidly. However, with plural kinds of epoxy resins mixed for use, viscosity can be prevented from being changed rapidly.

As the ultraviolet curing cation polymeric starter, aromatic diazonium salt, aromatic iodonium salt, aromatic sulfonium salt, aromatic selenium salt, or the like can be cited. As preferable example, aromatic sulfonium salt is cited.

For the flexibility providing agent, there can be named the one that is usable for adjusting the melting viscosity of the polymeric epoxy resin, such as phenoxy resin, polymeric epoxy resin, polyvinyl acetal, polysulfone, polyester, polyurethane, polyamide, polyimide, polycarbonate, polyether, polysiloxane, polyether imide, polyvinyl, epoxy acrylate, thermoplastic elastomer, acid-end nitryl rubber, and diglycidyl ester dimmer acid, among some others. The adoptability thereof is determined in consideration of the compatibility and resistance to ink of the epoxy resin.

Also, the addition of binder as an agent for providing flexibility should preferably be made within a range of approximately 5 to 30 wt % from the viewpoint of the melting viscosity control of adhesive, and the provision of strong adhesive property by optimizing the bridge density.

Also, for the enhancement of resistance to alkali, close contactness, and the like, it may be possible to add silane coupling agent. As the silane coupling agent, there can be named the one, such as β-(3,4epoxy cyclohexsil) ethyltrimethoxy silane, γ-glycidoxy propyltrimethoxy silane, γ-glycidoxy propylmethyl dimethoxy silane, γ-glycidoxy polypromethyl diethoxy silane, γ-isocyanate propyltriethoxy silane, γ-isocyanate propyltrimethoxy silane, vinyl triethoxy silane, vinyl trimethoxy silane, γ-methacryloxy propyltrimethoxy silane, γ-methacryloxy propyltriethoxy silane, and γ-mercapto propyltrimethoxy silane, among some others. However, the amino silane coupling agent, which is generally used as silane coupling agent, is not preferably applicable to the present invention, because it traps the cation that contributes to light curing reaction.

These adhesives can be coated and formed on one of the members to be bonded by means of screen printing, flexographic printing, or the like if the adhesive is in the from of liquid at normal temperature or to be transferred for bonding by means of stamping method or the like. Also, if the adhesive is in the sold form at the normal temperature, it can be coated after dissolved in a general solvent or coated by means of thermal transfer method or hot-melt method. Most preferably, the adhesive is dissolved in a general solvent to form a dry film by coating it on a film, such as polyethylene telephthalate film, and then, coated on the bonding member by the thermal transfer method using such film.

The adhesive using epoxy resin in accordance with the present invention is excellent in the stable preservation, and it is confirmed that the polymeric film material produced by coating such agent multiply in a considerable length shows no deterioration in the property thereof even when stored for a long time.

Hereunder, the present invention will be made in accordance with the embodiments thereof. However, it is to be understood that the present invention is not necessarily limited to such embodiments given below.

Now, in conjunction with FIGS. 12 and 21, the description will be made of a method for manufacturing an ink jet head of the present invention.

(First Embodiment)

Coating liquid for the bonding layer 23*a* is prepared by mixing and dissolving 80 portions of Epicoat 1001 (product name: manufactured by Oil Shell Epoxy Inc.) as epoxy resin; 20 portions of PKHJ phenoxy resin (product name: manufactured by Union Carbide Inc.) as agent for providing flexibility; 5 portions of silane coupling agent (Product name A187: manufactured by Nippon Unicar Inc.), and 1 portion of ultraviolet curing cation polymeric starter (product name SP170: manufactured by Asahi Denka K.K.) in cyclohexanon in a solid content of 30 wt %.

Next, as the polymeric film material 22, the following coating film is formed on the Upylex (product name: manufactured by Ube Kosan K.K.) having film thickness of 25 μm, width of 180 mm, and length of 200 m by means of micro-gravure rolling method. At first, solution of 10 wt % (solvent: CT-solv180) of CTX (product name: manufactured by Asahi Glass K.K.) is coated by use of #250 gravure roller as water repellent film, and dried at 150° C. in a drying furnace. This coating film is wound with the inclusion of polypropylene (product name Tolefan; manufactured by Toray K.K.) in a thickness of 25 μm on the coated surface thereof. Then, on this coating film, the aforesaid PVA protection film is coated as the protection layer 24 by use of #250 mesh roller, and wound after dried.

Figure 12:
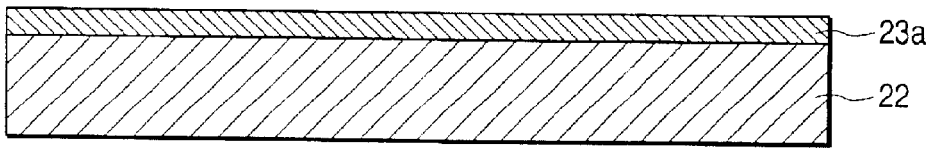
FIG. 12 is a cross-sectional view that shows the nozzle structure of the present invention in a stage before a protection layer is formed.
Figure 13:
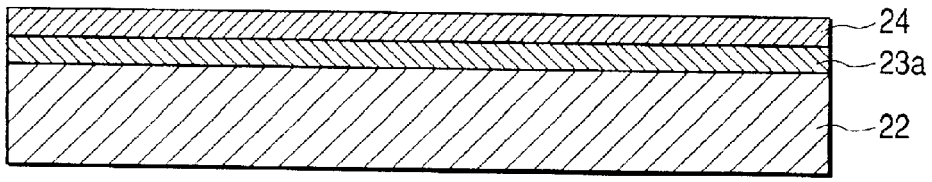
FIG. 13 is a cross-sectional view that shows the nozzle structure of the present invention in a state where the protection layer is formed on the adhesive layer side.

Further, on the opposite face, the coating liquid of the aforesaid adhesive layer 23*a* is coated by use of #200 gravure roller to form the bonding layer 23*a* (FIG. 12). Then, the aforesaid PVA protection film is coated likewise to form the protection layer 24 (FIG. 13). Moreover, the coated surface is protected by the polypropylene film. The thickness of each of these coated films is: the CTX film is 0.2 μm; the protection film 24 is 0.5 μm; and the adhesive layer 23*a* is 1.5 μm. After coating, the aforesaid coated film is cut in a width of 25 mm, and sprocket holes are formed for use of conveyance.

Figure 14:
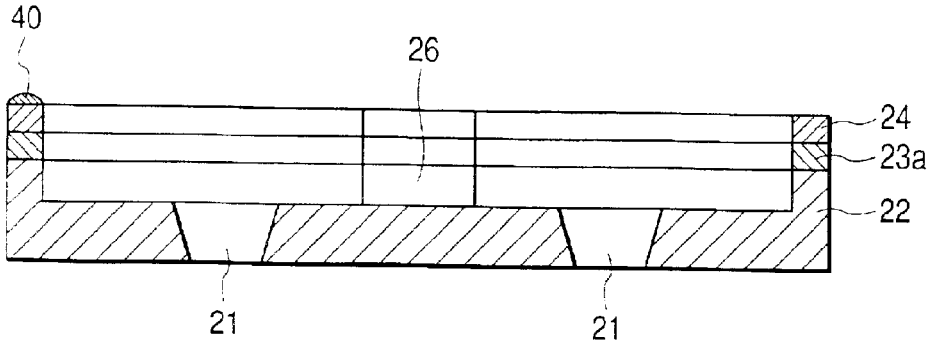

For the nozzle structural member 20, processing is executed by the KrF excimer laser beam of wavelength λ=248 nm, which is adjusted to make the irradiating energy of 1.3 J/cm$^2$ on the processing surface. This process is carried out for the ink flow path portion 26, and ink discharge port 21 in that order, while the masks are being exchanged as needed (FIG. 14).

Figure 15:
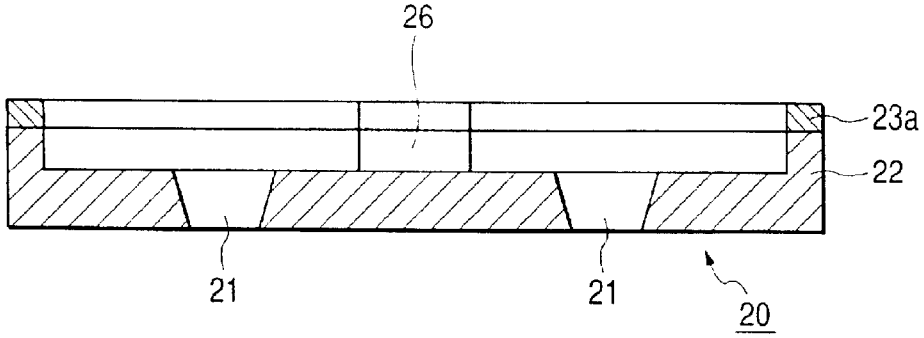
FIG. 15 is a cross-sectional view which shows the nozzle structure of the present invention in a state after the protection layer is removed.
Figure 16:
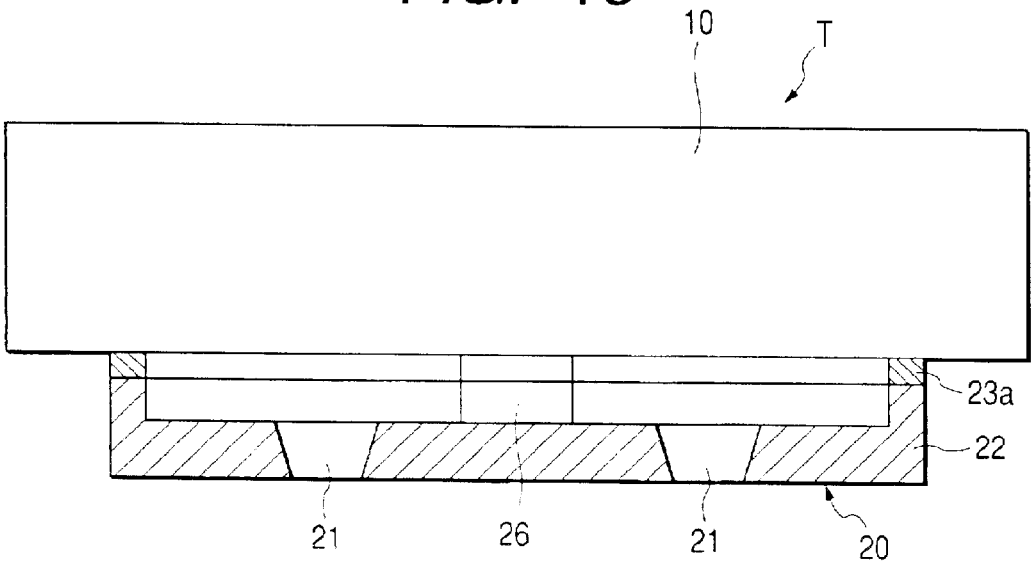
FIG. 16 is a cross-sectional view that shows the discharge element formed by bonding the nozzle structural member and the substrate in accordance with the present invention.
Figure 17:
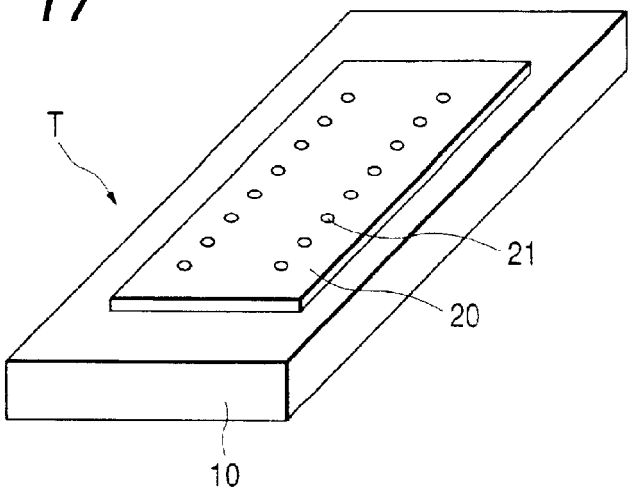
FIG. 17 is an enlarged perspective view that shows the discharge element of the ink jet head in accordance with the present invention.

Subsequently, the protection layer 24 is removed by water rinsing, and dried (FIG. 15), and then, ultraviolet rays are is irradiated by use of a high-tension mercury lamp from the 1 J/cm$^2$ adhesive layer 23*a* side to activate the ultra violet curing cation polymeric starter. After that, the nozzle structural member 20 is positioned to the substrate 10 having an electrothermal converting element formed thereon, and bonded thereto by heating 10 kgf/cm$^2$ at 100° C. for 3 seconds. Then, the regular curing is carried out at 150° C. for 1 hour for the bonded member as it is, while giving a load of 10 kgf/cm$^2$ so as not to allow any positional displacement to occur between the discharge port(s) 21 and the electrothermal converting element(s) (FIG. 16). In this way, the discharge element T shown in FIG. 17 is manufactured. The bonding strength between the polymeric film material 22 and the substrate 10 of the bonded member is evaluated by known T-peel test, with the result that it has a sufficient strength of 200 g. Also, there is no peeling in the reservation assessment, which is carried out by immersing it in ink at 60° C. for 1 month. Also, this discharge element T is assembled with an ink tank, and TAB tape for the ink discharge evaluation, with the result that prints are obtained in good condition.

In this respect, the term "activation" referred to in the present embodiment is defined as follows:

The ultra violet curing adhesive or the like usually contains at least reactive monomer or oligomer and photo-polymeric starter, and the photo-polymeric starter is activated by the irradiation of ultraviolet irradiation and becomes catalyst to enable the reactive monomer or other reactive group to react for curing, thus executing the two-staged curing reaction. The usual ultraviolet curing adhesive is used at the room temperature or the like. Therefore, the activation of the photo-starter by the irradiation of ultraviolet rays and the monomer reaction make progress simultaneously for curing. However, whereas the activation of the ultraviolet curing cation polymeric starter of the present invention is extremely quick, the reaction speed of monomer at around the room temperature is slow. Characteristically, therefore, unless temperature is given, the curing reaction does not make sufficient progress. The present invention utilizes such characteristics, and the activation here is defined to be such as to make the cation polymeric starter reactive to the monomer by the irradiation of ultraviolet rays.

(Second Embodiment)

Coating liquid for the bonding layer 23*a* is prepared by mixing and dissolving 80 portions of the aforesaid Epicoat 1001 as epoxy resin; 20 portions of phenoxy resin as agent for providing flexibility; 5 portions of silane coupling agent (Product name A187: manufactured by Nippon Unicar Inc.), and 1 portion of diphenyl iodnium hexafluoro anitimonate (Midori Kagaku Sample) as ultraviolet curing cation polymeric starter in cyclohexanon in a solid content of 30 wt %. This coating liquid is coated on polyimide film of 25 μm (product name Upylex: manufactured by Ube Kosan K.K.) to form a adhesive layer 23*a* in a thickness of 2 μm (FIG. 12). After that, a protection layer 24 is formed in a thickness of 0.5 μm (FIG. 13) to obtain the nozzle structural member 20. For the nozzle structural member 20, processing is executed by the KrF excimer laser beam of wavelength γ=248 nm, which is adjusted to make the irradiating energy of 1.3 J/cm$^2$ on the processing surface (FIG. 14).

The protection layer 24 is removed by water rinsing, and dried (FIG. 15), and then, after ultraviolet rays is irradiated by 1 J/cm$^2$, the aforesaid nozzle structural member 20 is positioned to the substrate 10 and bonded thereto by heating 10 kgf/cm$^2$ at 150° C. for 20 seconds (FIG. 16). Then, the discharge element T is manufactured in the same manner as shown in FIG. 17. Any nozzle clogging is observed.

The bonding strength is evaluated by the aforesaid T-peel test, with the result that it has a sufficient strength of 160 g. Further, ink discharge evaluation is carried out, with the result that prints are obtained in good condition.

(Third Embodiment)

100 weight portions of bisphenol A epoxy resin (Epicoat 1001 manufactured by Oil Shell Epoxy Inc.) and 1 weight portion of ultraviolet cation curing polymeric starter (SP-170 manufactured by Asahi Denka Kogyo K.K.) are dissolved in cyclohexanon to obtain solution A of substance composed of photosensitive resin. The solution A of the substance composed of photosensitive resin is coated on polyimide resin film (Upylex manufactured by Ube Kosan K.K.) to produce the dry film A in a film thickness of 3 μm.

On the Si of the heater substrate 1, a plurality of heat generating resistive elements 5 is arranged by means of semiconductor process to be utilized for generating a bubble, while liquid flow paths 11 are formed. FIGS. 18A, 18B, 18C and 18D are views that schematically illustrate the processes from the transfer of adhesive to the completion of bonding.

Figure 18A:
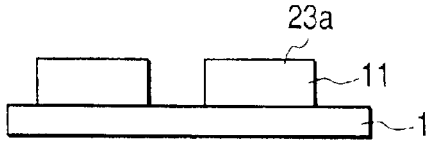
FIGS. 18A, 18B, 18C and 18D are views that illustrate the fundamental flow of bonding process in accordance with the present invention.

The aforesaid dry film A is transferred to the liquid flow path 11 by means of thermal transfer method. Here, as adhesive 23*a*, the substance A composed of photosensitive resin is selectively transferred (FIG. 18A).

The thermal transfer method described here is a method in which after giving heat while the transferred object having adhesive to be coated, and the dry film being in contact under pressure, the base film that forms the dry film is peeled, thus the transfer coating being performed by transferring only the adhesive layer to the transferred object. The thermal transfer method uses such principle that the adhesive solidified at normal temperature is melted by heat to present bonding strength with respect to the transferred object, and then, after cooling, the adhesive is peeled off from the base film when the base film is peeled off, thus being coated on the transferred object. If any irregularity exists on the transferred object, the recessed portion is not in contact with the dry film, no transfer ensues. The adhesive is transferred to only extruded portions. At the time of transfer, no ultraviolet rays are irradiated to the adhesive, and therefore no chemical reaction occurs on the adhesive even if heat is given thereto.

Figure 9:
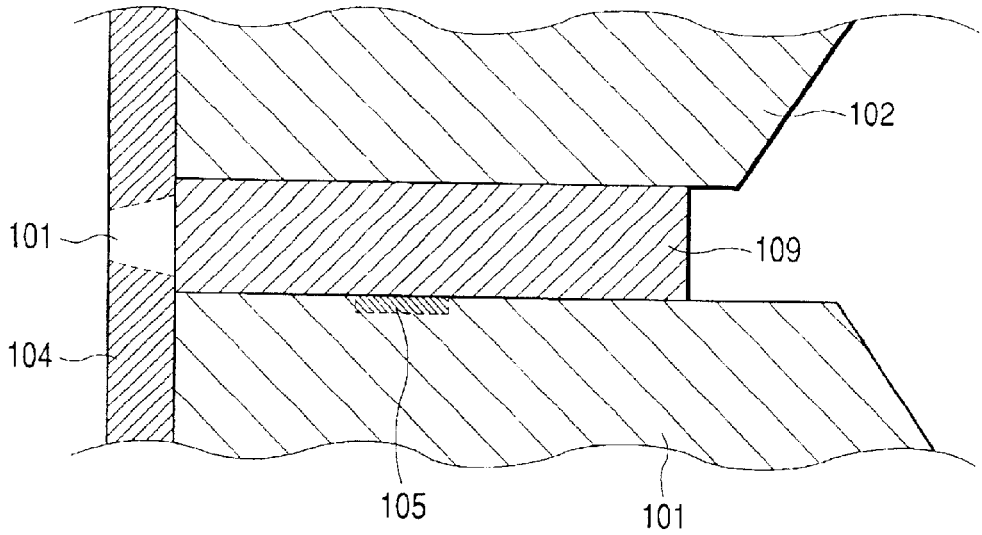
FIG. 9 is a cross-sectional view that shows the nozzle structural member to which the present invention is applicable.
Figure 18B:
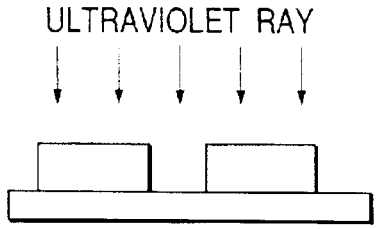
Figure 18C:
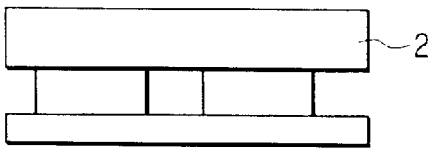
Figure 18D:
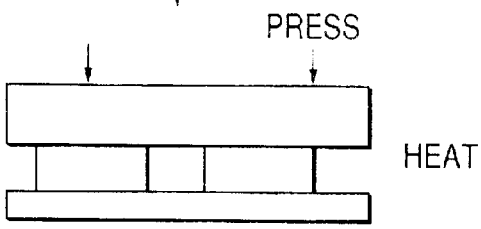

Ultraviolet rays of 365 nm is irradiated to the substance A composed of photosensitive resin for 1 J/cm$^2$ by use of the high-tension mercury light manufactured by Ushio Denki K.K. to activate curing agent (FIG. 18B). Here, the ultraviolet rays of 365 nm is the value obtained by measuring it using the 365 nm sensor of the illuminometer manufactured by Ushio Denki K.K., and other light than the aforesaid wavelength is also irradiated. In this condition as it is, no reaction is completed nor any bonding strength occurs. In continuation, the ceiling plate member 2 is positioned (FIG. 18C). The work piece is heated at 120° C. by use of a hot press apparatus to press it (FIG. 18D), thus completing reaction for bonding the heater substrate 1 and the ceiling plate member 2 to obtain the chip unit. To the chip unit, the orifice plate 4 is bonded to manufacture the ink jet head shown in FIG. 9. this head is immersed in ink of pH 12 and leave it intact for 3 months. After that, discharge characteristics and printing performance thereof are evaluated, with the result that it demonstrates characteristics in good condition.

(Fourth Embodiment)

100 weight portions of bisphenol A epoxy resin (Epicoat 828 manufactured by Oil Shell Epoxy Inc.), 1 weight portion of ultraviolet cation curing polymeric starter (SP-170 manufactured by Asahi Denka Kogyo K.K.), and 5 weight portions of silane coupling agent (γ-glycidoxy propyltrimethoxy silane) (A-187 manufactured by Nippon Unicar Inc.) are dissolved in cyclohexanon to obtain solution B of substance composed of photo-sensitive resin.

The solution B of the substance composed of photosensitive resin is coated on polyimide resin film (Upylex manufactured by Ube Kosan K.K.) to produce the dry film B in a film thickness of 3 μm.

On the Si of the heater substrate 1, a plurality of heat generating resistive elements 5 is arranged by means of semiconductor process to be utilized for generating a bubble, while liquid flow paths are formed. The aforesaid dry film B is transferred to the liquid flow paths. Here, the substance B composed of photo-sensitive resin is selectively transferred.

Figure 10:
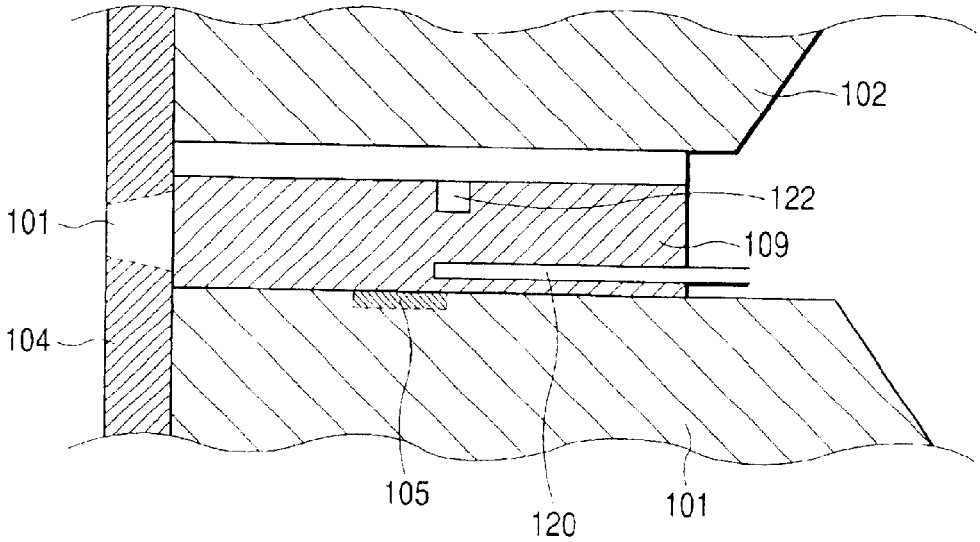
FIG. 10 is a cross-sectional view that shows the nozzle structural member having the upper displacement regulating member and the movable member, to which the present invention is applicable.
Figure 11A:
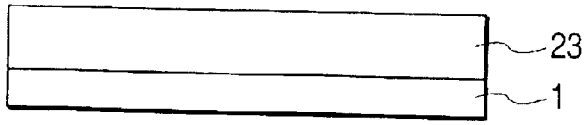
FIGS. 11A, 11B, 11C, 11D and 11E are views that illustrate the fundamental flow of the conventional bonding process.
Figure 11B:
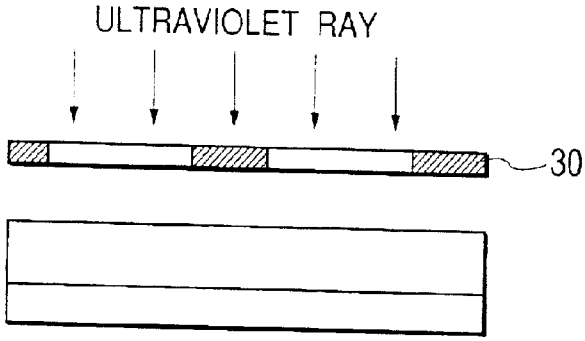
Figure 11C:
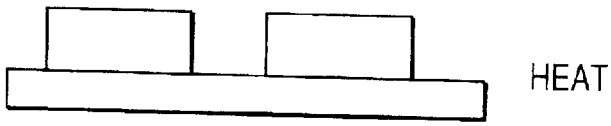
Figure 11D:
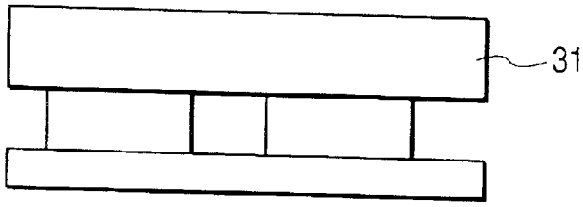
Figure 11E:
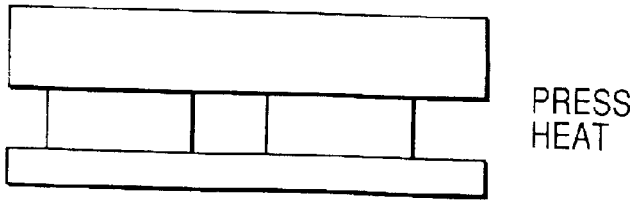

Ultraviolet rays of 365 nm are irradiated to the substance B composed of photosensitive resin for 1 J/cm$^2$ to activate the curing agent. In this condition as it is, no reaction is completed nor any bonding strength occurs. In continuation, the ceiling plate member 2 is positioned. The work piece is heated at 120° C. as in the third embodiment to complete reaction for bonding the heater substrate 1 and the ceiling plate member 2 to obtain the chip unit. To the chip unit, the orifice plate 4 is bonded to manufacture the ink jet head shown in FIG. 10. This head is immersed in ink of pH 12 and leave it intact for 3 months. After that, discharge characteristics and printing performance thereof are evaluated, with the result that it demonstrates characteristics in good condition.

(Comparative Example A)

100 weight portions of bisphenol A epoxy resin (Epicoat 827 manufactured by Oil Shell Epoxy Inc.), 1 weight portion of thermal polymeric starter (CP-77 manufactured by Asahi Denka Kogyo K.K.), and 5 weight portions of silane coupling agent (γ-glycidoxy propyltrimethoxy silane) (A-187 manufactured by Nippon Unicar Inc.) are dissolved in cyclohexanon to obtain solution C of substance composed of photo-sensitive resin.

The solution C of the substance composed of photosensitive resin is coated on polyimide resin film (Upylex manufactured by Ube Kosan K.K.) to produce the dry film C in a film thickness of 3 μm.

On the Si of the heater substrate 1, a plurality of heat generating resistive elements 5 is arranged by means of semiconductor process to be utilized for generating a bubble, while liquid flow paths are formed. The aforesaid dry film C is transferred to the liquid flow paths. Here, the substance C composed of photo-sensitive resin is selectively transferred.

The ceiling plate member 2 is positioned, and heated at 150° C. for 1 hour to complete reaction.

Then, the heater substrate 1 and the ceiling plate member 2 are bonded to obtain the chip unit. To the chip unit, the orifice plate 4 is bonded to manufacture the ink jet head shown in FIG. 9. However, the liquid flow paths are clogged and disabled discharges occur, making it impossible to obtain good prints.

(Fifth Embodiment)

Figure 19:
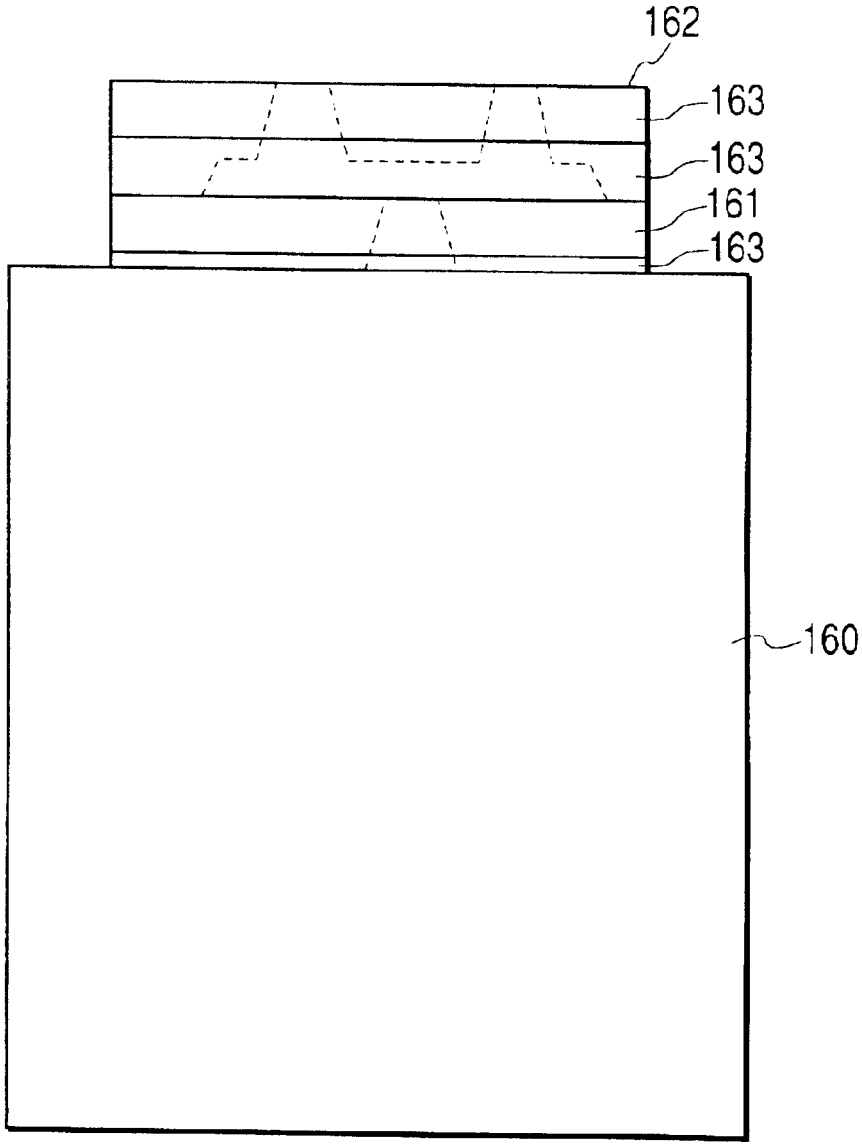
FIG. 19 is a cross-sectional view that shows an ink tank formed by means of bonding in accordance with the present invention.

94 portions of bisphenol A epoxy resin (Epicoat 827 manufactured by Oil Shell Epoxy Inc.), 1 portion of SP-170 (manufactured by Asahi Denka Kogyo K.K.), and 5 portions of A-187 (manufactured by Nippon Unicar Inc.) are mixed and coated on the ink tank 160 the structure of which is shown in FIG. 19. According to this structure, it is possible to apply the adhesive to the portion where the heater board 161 is bonded to the ink tank, and the portion where the orifice plate 162 having the ink discharge port 163 arranged therefor is bonded to the heater board. The structure, in which a heater board is bonded to an ink tank, is disclosed on Page 48 of Hewlett-Packard Journal February 1994.

Then, as in the third embodiment, ultraviolet rays is irradiated by use of the high-tension mercury light manufactured by Ushio Denki K.K. for 50 mJ/cm$^2$. Immediately after irradiation (within 5 seconds), the heater board is aligned on the adhesive to be in contact under pressure. The work piece is heated at 70° C. to cure the adhesive. As in the fourth embodiment, the work piece is immersed in ink at 60° C. for 3 months. However, there occurs no peeling of the adhesive.

For the present structure, if ultraviolet cation polymeric adhesive is applied in order to bond the heater board directly to the plastic ink tank, it becomes possible to adopt an inexpensive plastic having low resistance to heat for the ink tank. Also, the curing time is made shorter. Also, if curing is possible at a low temperature, it becomes possible to minimize the positional displacement that may occur due to temperature rise.

(Sixth Embodiment)

In conjunction with FIGS. 20A, 20B, 20C, 20D and 20E, the description will be made of the present embodiment, in which a heater board is mounted on the standard heater plate at high speed and in high precision.

Figure 20A:
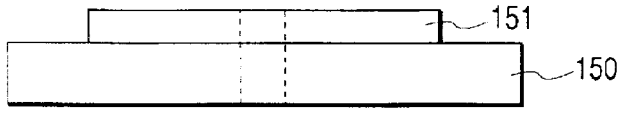
FIGS. 20A, 20B, 20C, 20D and 20E are views that illustrate the flow of process in which the heater board is mounted on the standard plate at high speed and in high precision in accordance with the present invention.
Figure 20B:
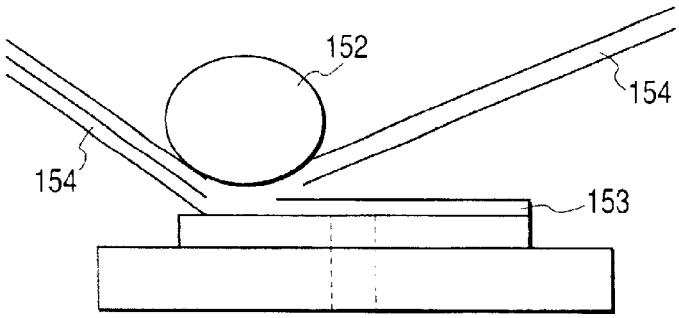
Figure 20C:
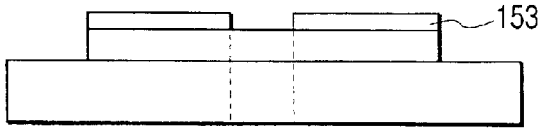
Figure 20D:
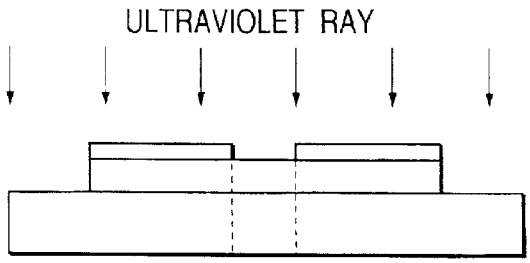
Figure 20E:
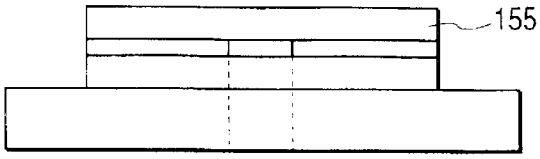

A reference numeral 150 designates the standard plate. Owing to the use of the thermal transfer method for coating adhesive, there is formed an extrusion 151 of 50 $\mu$m on the standard plate 150. Also, in the center of the plate, a through hole is formed for ink supply. FIG. 20B shows the process of transferring adhesive. For the dry film, adhesive 153 is coated on the base film 154 in a thickness of 20 $\mu$m. Adhesive is in contact with the standard plate under pressure, and the adhesive is coated on the standard plate by enabling a heated roller 152 to pass. FIG. 20C shows the status of the plate having the adhesive coated thereon. FIG. 20D shows the process in which ultraviolet rays are irradiated to activate the beam starter in the adhesive. This structure is formed in the configuration of the standard plate (provided with the extrusion) having the patterned coating of adhesive, and therefore it is possible to perform the irradiation on all the surface at a time without using mask or the like. FIG. 20E shows the status of the adhesive layer and the heater board being positioned, pressed, and heated to be bonded.

To the standard alumina plate having the through hole provided therefor to supply ink, adhesive is transferred using the dry film produced as in the first embodiment for coating thereon. In this respect, the adhesive coating location is formed in an extrusion of 50 $\mu$m in advance, and the structure is arranged so that adhesive can be coated selectively. Next, ultraviolet rays are irradiated to mount the heater board on the substrate. The mounted head is structured to be able to perform pulse heating, and after being positioned, the heater board is firmly bonded by heating at 100° C. for 5 seconds.

The sample thus prepared is given the ink immersion test as in the fourth embodiment, with the result that there is no peeling of the adhesive.

(Seventh Embodiment)

60 portions of Epicoat 1003, epoxy resin manufactured by Oil Shell Epoxy Inc., 34 portions of phenoxy resin manufactured by Tomoe Kogyo K.K., 1 portion of SP-170, and 5 portions of A-187 are dissolved in cyclohexanon of 100 portions, and coated in a thickness of 50 $\mu$m on polyimide film of 10 $\mu$m thick by use of a roller coater. The Upylex manufactured by Ube Kosan K.K. is used for the polyimide film here.

On this film, ink flow paths and ink discharge port is formed by use of an excimer laser irradiation apparatus.

The film thus formed is positioned on the heater board, and then, heated at 120° C. The film and the heater board are pressed to be bonded. This sample is also immersed in ink, with the result that no peeling occurs. The micro-structure, such as ink flow paths, formed by laser processing is also bonded in good condition with only a slight deformation.

Hereinafter, the description will be made of the embodiments in the case where bonding is made by use of the adhesive solidified at normal temperature, which contains at least ultraviolet curing cation polymeric starter and epoxy resin.

(Eighth Embodiment)

Figure 21:
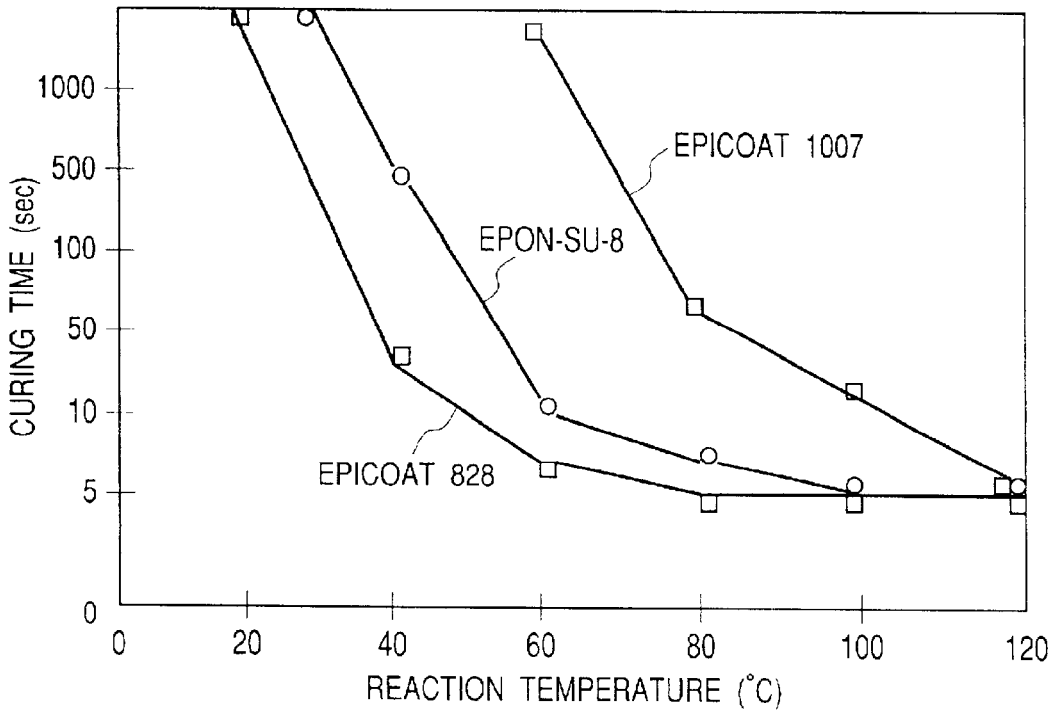
FIG. 21 is a view that shows the relationship between the reaction temperature and curing time for epoxy resins having different melting points.

FIG. 21 is a view that shows the relationship between temperature and time when epoxy resins having different melting points, ultraviolet curing cation polymeric starter (SP-170 manufactured by Asahi Denka K.K.), and silane coupling agent, A-187 manufactured by Nippon Unicar Inc. are used, and heated after irradiation of ultraviolet rays for 3 J/cm$^2$. To the epoxy resin, the SP-170 of 1 wt %, and the silane coupling agent of 5 wt % are added. In this respect, the presence and absence of curing is determined by the presence and absence of gelification in the immersion in methylisobutyl ketone. In FIG. 14, when epoxy resin, Epicoat 828, is used, curing occurs at the room temperature in approximately 30 minutes after the irradiation of ultraviolet rays. However, if the Epicoat 1001, the melting point of which is 65° C., is used, it takes 3 hours. Here, EPON-SU-8 (manufactured by US Shell Chemical, Inc.), the melting point of which is 85° C., and the Epicoat 1007, the melting point of which is 127° C., are found to show almost no reaction.

It is, therefore, understandable that by use of epoxy having the melting point of 50° C. or more, reactivity is suppressed at the room temperature so as to make the operativity favorable.

100 weight portions of bisphenol A epoxy resin (Epicoat 1001 manufactured by Oil Shell Epoxy Inc.), 1 weight portion of ultraviolet curing cation polymeric starter (SP-170 manufactured by Asahi Denka Kogyo K.K.) are dissolved in cycloxanon to obtain solution D of substance composed of photo-sensitive resin.

The solution D of the substance composed of photosensitive resin is coated on polyimide resin film (Upylex manufactured by Ube Kosan K.K.) to produce the dry film D in a film thickness of 3 $\mu$m.

On the Si of the heater substrate 1, a plurality of heat generating resistive elements 5 is arranged by means of semiconductor process to be utilized for generating a bubble, while liquid flow paths are formed. The aforesaid dry film D is transferred to the liquid flow paths by thermal transfer method. Here, the substance D composed of photosensitive resin is selectively transferred. The temperature of transfer at this time is 120° C.

Ultraviolet rays of 365 nm is irradiated to the substance D composed of photosensitive resin for 1 J/cm$^2$ to activate adhesive. In this condition as it is, no reaction is completed nor bonding strength occurs. In continuation, the ceiling plate member 2, which is formed by Si as main material, is positioned, and heated at 100° C. for 5 minutes to complete reaction. Then, the heater substrate 1 and the ceiling plate member 2 are bonded to obtain the chip unit. To the chip unit, the orifice plate 4 is bonded to manufacture the ink jet head shown in FIG. 17. The head is immersed in ink of pH 12, and after left intact for 3months, the discharge characteristics and printing thereof are evaluated, with the result that it shows characteristics in good condition.

(Ninth Embodiment)

100 weight portions of bisphenol A epoxy resin, the melting point of which is 65° C. (Epicoat 1001 manufactured by Oil Shell Epoxy Inc.) and 1 weight portion of ultraviolet curing cation polymeric starter (SP-170 manufactured by Asahi Denka Kogyo K.K.), 5 weight portions of silane coupling agent (γ-glicidoxy propyltrimethoxy silane) (A-187 manufactured by Nippon Unicar Inc.) are dissolved in cycloxanon to obtain solution E of substance composed of photosensitive resin.

The solution E of the substance composed of photosensitive resin is coated on polyimide resin film (Upylex manufactured by Ube Kosan K.K.) to produce the dry film E in a film thickness of 3 μm.

On the Si of the heater substrate 1, a plurality of heat generating resistive elements 5 is arranged by means of semiconductor process to be utilized for generating a bubble, while liquid flow paths are formed. The aforesaid dry film E is transferred to the liquid flow paths by thermal transfer method. Here, the substance E composed of photosensitive resin is selectively transferred.

Ultraviolet rays of 365 nm is irradiated to the substance E composed of photosensitive resin for 1 J/cm$^2$ to activate adhesive. In this condition as it is, no reaction is completed nor bonding strength occurs. In continuation, the ceiling plate member 2 is positioned, and heated at 100° C. for 30 seconds to complete reaction. Then, the heater substrate 1 and the ceiling plate member 2 are bonded to obtain the chip unit. To the chip unit, the orifice plate 4 is bonded to manufacture the ink jet head shown in FIG. 17. The head is immersed in ink of pH 12, and after left intact for 3 months, the discharge characteristics and printing thereof are evaluated, with the result that it shows characteristics in good condition.

(Comparative Example B)

100 weight portions of bisphenol A epoxy resin (Epicoat 1007, melting point 127° C., manufactured by Oil Shell Epoxy Inc.), 1 weight portion of thermal polymeric starter (CP-77 manufactured by Asahi Denka Kogyo K.K.), and 5 weight portions of silane coupling agent (γ-glycidoxy propyltrimethoxy silane) (A-187 manufactured by Nippon Unicar Inc.) are dissolved in cyclohexanon to obtain solution F of substance composed of photo-sensitive resin.

The solution F of the substance composed of photosensitive resin is coated on polyimide resin film (Upylex manufactured by Ube Kosan K.K.) to produce the dry film F in a film thickness of 3 μm.

On the Si of the heater substrate 1, a plurality of heat generating resistive elements 5 is arranged by means of semiconductor process to be utilized for generating a bubble, while liquid flow paths are formed. The aforesaid dry film F is transferred to the liquid flow paths at a transfer temperature of 160° C. Here, the substance F composed of photo-sensitive resin is selectively transferred.

This member is irradiated by ultraviolet rays for 3 J/cm$^2$. Then, the ceiling plate member 2 is positioned, and heated at 150° C. for 30 minutes. However, the adhesive is cured, while it does not flow good enough. As a result, any bonding strength cannot be obtained in good condition.

As described above, ultraviolet cation polymeric resin is able to make the epoxy open ring polymerization promoted, because the ultraviolet curing cation polymeric starter is activated by the irradiation of ultraviolet rays. However, if epoxy resin, which is solidified at normal temperature or preferably, which has the melting point of 50° C. or more, is used, it becomes possible to suppress the dispersion of the activated ultraviolet curing cation polymeric starter, hence suppressing the polymeric reaction until heat is given. As a result, the process, in which two members are pressed to be bonded and given heat so as to enable the adhesive to flow for the dispersion of catalyst, and the process, in which the catalyst enables epoxy to perform the open ring polymerization, occur instantaneously, hence making it possible to cure the adhesive at high speed.

Therefore, exposure is possible using high-power light in a short period of time. After two members are bonded, adhesive is heated at a temperature higher than the melting point thereof. Then, the adhesive is molten and cured to complete bonding. However, when epoxy resin, the melting point of which is 120° C. or more, is used, bonding reaction is extremely quick at such temperature even if heat is given at a temperature higher than the melting point after bonding. As a result, there are some cases that sufficient bonding strength is not obtained eventually.

Here, with the epoxy resin, which is solidified at normal temperature, or more preferably, the melting point of which is made 50° C. or more and 120° C. or less, the dispersion of activated ultraviolet curing cation polymeric starter is suppressed, and almost no reaction occurs at normal temperature. Therefore, with the temperature rise due to the irradiation of ultraviolet rays, no reaction takes place, thus making it possible to carry out exposure with high-power light in a short period of time. Also, there is no need for any strict control of time and temperature up to bonding.

As described above, in accordance with the present invention, it is possible to provide an ink jet head having excellent stability of preservation, as well as high resistance to ink and heat with the application of at least epoxy resin and the adhesive that contains ultraviolet curing cation polymeric starter. Also, in accordance with the present invention, before bonding, ultraviolet curing cation polymeric starter is activated, and subsequently heat is given in the bonding process to make reaction progressed rapidly. As a result, a sufficient bonding strength can be obtained even if the thickness of adhesive layer should be made small along with the higher structural precision of an ink jet recording head. Also, when polymeric film is used, in particular, as the member that forms a discharge port, the present invention makes it possible to position the ink discharge ports and the electrothermal converting elements on the substrate in high precision, because these are instantaneously bonded in a short period of time and subsequently, given regular bonding in a state of keeping them not to allow any positional displacement to occur by unexpected movement. Thus, with the present invention, it is possible to provide a method for manufacturing an ink jet head in high precision, which is also excellent in productivity. Also, since the adhesive is cured at once when heat is given, there is no excessive portion that may overflow into the ink flow paths. Further, in accordance with the present invention, the irradiation of ultraviolet rays is given to activate the adhesive having epoxy resin and ultraviolet curing cation polymeric starter as the main components thereof, and bonding is possible by rapid progress of reaction by giving heat. As a result, it becomes possible to bond even the members themselves, which are opaque to the wavelength of 380 nm or less. Also, when the adhesive that is liquified at normal temperature is used, the irradiation of ultraviolet rays is made with extremely weak beams so that the temperature of adhesive is not allowed to rise. After that, bonding is made in a short period of time, hence making it possible to prevent the viscosity of the adhesive from being changed due to the progress of reaction after the irradiation of ultraviolet rays, as well as to prevent the curing reaction from advancing due to the heat that may be given when ultraviolet rays are irradiated.

Also, with the adhesive that is solidified at normal temperature, or more preferably, with the one having the melting point of the epoxy resin thereof being 50° C. or more and 120° C. or less, the dispersion of the activated ultraviolet curing cation polymeric starter is suppressed, and almost no reaction is given at normal temperature. As a result, no reaction results even by the temperature rise when ultraviolet rays are irradiated, hence effectuating exposure with high-power beams in a short period of time, while making it unnecessary to control time and temperature strictly.

Further, when the melting viscosity of the adhesive that contains agent for providing flexibility is controlled to make the bridge density appropriate, there is no possibility that the adhesive flows to make highly precise bonding possible even if fine structures are formed for the aforesaid members. As a result, it becomes possible for the flow path walls formed for the heater substrate to obtain close contactness in good condition, while preventing the liquid flow paths from being clogged. Thus, a highly reliable ink jet head with stable discharge performance can be provided.

Also, the present invention is particularly effective for bonding the portions of an ink jet head to be in contact with ink. The invention is not only applicable to the thermal-ink jet head, but also, to the piezo-ink jet head.

What is claimed is:

1. A method for manufacturing an ink jet head by bonding a member at least having a discharge port for discharging ink, and a substrate having an energy generating element to generate energy for discharging ink, comprising the steps of:

coating, on a bonding portion between the member and the substrate, a liquid-like adhesive containing at least ultraviolet curing cation polymeric starter and epoxy resin having a melting point between greater than or equal to 50° C. and less than or equal to 120° C.;

irradiating an ultraviolet ray to the liquid-like adhesive to activate the ultraviolet curing cation polymeric starter while restricting dispersion thereof;

positioning the member and the substrate at a position for bonding and applying pressure to the member and the substrate; and heating the member and the substrate at a temperature not lower than the melting point of the liquid-like adhesive to cure the liquid-like adhesive.

2. A method for manufacturing an ink jet head according to claim 1, wherein the thickness of the adhesive layer is 10 $\mu$m or less.

3. A method for manufacturing an ink jet head according to claim 1, wherein the ultraviolet curing cation polymeric starter is aromatic onium salt.

4. A method for manufacturing an ink jet head according to claim 1, wherein the liquid-like adhesive contains an agent for providing flexibility.

5. A method for manufacturing an ink jet head according to claim 1, wherein the member and the substrate are formed of a material having Si as the main component thereof.

6. A method for manufacturing an ink jet head according to claim 1, wherein the ultraviolet rays are beams of wavelength of 380 nm or less.

7. A method for manufacturing an ink jet head according to claim 1, wherein either the member or the substrate is formed by opaque material to a beam having a wavelength of 380 nm or less.

8. A method for manufacturing an ink jet head according to claim 1, wherein the activation is a state that the cation polymeric starter is reactive to a monomer by irradiating the ultraviolet ray.

* * * * *

UNITED STATES PATENT AND TRADEMARK OFFICE

CERTIFICATE OF CORRECTION

PATENT NO. : 6,790,309 B2
DATED : September 14, 2004
INVENTOR(S) : Masashi Miyagawa et al.

It is certified that error appears in the above-identified patent and that said Letters Patent is hereby corrected as shown below:

Column 2,
Line 39, “ryas” should read -- rays --; and
Line 51, “component,” should read -- components, --.

Column 3,
Line 1, “soften” should read -- softened --; and
Line 4, “movable” should read -- a movable --.

Column 4,
Line 8, “ryas” should read -- rays --.

Column 5,
Line 34, “process.” should read -- process; --.

Column 7,
Line 2, “contactness,” should read -- contact, --;
Line 18, “from of” should read -- form of --;
Line 22, “dissolved” should read -- being dissolved --; and
Line 65, “dried.” should read -- being dried. --.

Column 8,
Line 18, “are is” should read -- are --; and
Line 45, “catalyst” should read -- a catalyst --.

Column 9,
Line 6, “a adhesive” should read -- an adhesive --;
Line 14, “rays is” should read -- rays are --; and
Line 63, “is irradiated” should read -- are irradiated --.

Column 10,
Line 10, “this” should read -- This --;
Lines 11 and 44, “leave it” should read -- is left --;
Lines 32, 56 and 66, “photo-sensitive” should read -- photosensitive --; and
Line 37, “any bonding strength occurs.” should read -- does any bonding strength occur. --.

Column 11,
Line 22, “rays is” should read -- rays are --.

UNITED STATES PATENT AND TRADEMARK OFFICE

CERTIFICATE OF CORRECTION

PATENT NO. : 6,790,309 B2
DATED : September 14, 2004
INVENTOR(S) : Masashi Miyagawa et al.

It is certified that error appears in the above-identified patent and that said Letters Patent is hereby corrected as shown below:

Column 12,
Line 61, “photo-sensitive” should read -- photosensitive --.

Column 13,
Lines 6 and 40, “is irradiated” should read -- are irradiated --;
Lines 16 and 49, “left” should read -- being left --;
Line 16, “3months,” should read -- 3 months --; and
Line 61, “photo-sensitive” should read -- photosensitive --.

Column 14,
Line 5, “photo-sensitive” should read -- photosensitive --;
Line 9, “good enough.” should read -- well enough. --;
Line 12, “make” should read -- promote --;
Line 12, “promoted” should be deleted; and
Line 54, “reaction progressed” should read -- the reaction progress --.

Column 15,
Line 38, “contactness” should read -- contact --.

Signed and Sealed this

Twenty-fifth Day of January, 2005

JON W. DUDAS
*Director of the United States Patent and Trademark Office*